US006818845B2

(12) United States Patent
Portmann

(10) Patent No.: US 6,818,845 B2
(45) Date of Patent: Nov. 16, 2004

(54) ELECTROMECHANICAL SWITCH

(75) Inventor: Paul Portmann, Schindellegi (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/964,940

(22) Filed: Sep. 27, 2001

(65) Prior Publication Data

US 2003/0057075 A1 Mar. 27, 2003

(51) Int. Cl.[7] ..... H01H 23/00
(52) U.S. Cl. ..... 200/302.3; 200/339; 200/553
(58) Field of Search ..... 200/302.3, 339, 200/302.1, 302.2, 512, 513, 517, 553, 562, 438, 406, 250, 260, 557, 333

(56) References Cited

U.S. PATENT DOCUMENTS 2,408,157 A * 9/1946 Adams ..... 200/302.2 X
2,409,483 A * 10/1946 Gandelot ..... 200/302.2
2,954,452 A * 9/1960 Neumann ..... 200/302.3
3,188,438 A * 6/1965 Lovasco ..... 200/302.3
3,732,390 A * 5/1973 Novak ..... 200/302.2
3,740,511 A * 6/1973 Westmoreland ..... 200/302.1
3,898,397 A * 8/1975 Devore et al. ..... 200/302.3 X
4,018,999 A * 4/1977 Robinson et al. ..... 200/517 X
4,536,625 A * 8/1985 Bebie ..... 200/339 X

* cited by examiner

*Primary Examiner*—Renee Luebke
(74) *Attorney, Agent, or Firm*—Pearne & Gordon LLP

(57) ABSTRACT

The switching element (1) of the switch per this invention is closely enveloped, at least in the area of its free end, by an elastic diaphragm (5) which also encloses, at a distance, the contact surfaces (2) facing the switching element (1) and which is tightly connected to the switch housing (4; 6). This tightly seals the contact region against the external environment of the switch and thus reliably prevents contamination and oxidation of the contact surfaces. As another advantageous feature, the number of switch components is thus reduced, a mechanical spring is not needed for retaining the switching element (1) in its engaged position, and the design permits miniaturization.

10 Claims, 3 Drawing Sheets

ELECTROMECHANICAL SWITCH

This invention relates to an electromechanical switch.

There are a great many different electromechanical switches on the market, designed to connect or disconnect electrical conductors. The fundamental mechanical concept of these switches is essentially the same, in that a movable, current-conducting switching element presses down on appropriate contact surfaces of the conductors or wires that connect to the switch, thus establishing the electrical connection or, respectively, the switching element is moved away from the contact surfaces, thus breaking the electrical connection. The switching element generally makes simultaneous contact with two neighboring contact surfaces, thus establishing the electrical connection between these two contact surfaces.

The switching element is traditionally moved by means of a lever which is contained in the same switch housing and is movably or rigidly connected to the switching element. This lever usually consists of an electrically nonconducting material or it is at least safely insulated from the switching element and the contact surfaces.

One inherent problem of this type of switches lies in the fact that due to the clearance needed for the movement between the lever and the switch housing it is not possible to completely seal the switch mechanism. Dirt and moisture can penetrate into the switch housing, soiling or oxidizing especially the contact surfaces and/or the switching element. This can lead to a significant deterioration of the functionality of the switch or cause it to fail altogether.

Switches which are exposed to such conditions and must therefore meet stringent weather-proofing requirements can be provided with additional seals which are traditionally positioned at least around the lever and provide a water-tight connection with the switch housing.

That is a costly solution since additional materials must be used. It also increases the size of the box, i.e. the switches thus equipped usually have greater dimensions. It is a solution that does not lend itself well to switches which must be kept small.

It is therefore the objective of this invention to introduce an electrical switch that can be produced in simple fashion and even with very small dimensions and which would permit reliable switching, i.e. circuit-connect and disconnect operations, while dependably protecting the switch unit against exposure to the effects of external moisture.

The invention meets this objective by means of an electrical switch having novel features as described herein.

A surprising discovery has revealed the possibility of sealing the switch mechanism with a diaphragm which at the same time and in advantageous fashion serves to provide electrical insulation of the free end of the switching element, which can thus function as the actuating surface of the switch and by means of which the switching element applies the contacting pressure on the contact surfaces. As an added advantage, the construction of this type of electromechanical switch is simplified insofar as separate, elastic elements serving to ensure alignment and to produce the necessary contact pressure, such as metal springs employed in conventional switches, can be dispensed with.

The elastic diaphragm exerts this contact pressure preferably by means of its defined prestressed condition between the switch housing and the switching element. This can be accomplished, for example, in that the diaphragm is pulled over the preferably pin-shaped switching element and, with a small amount of tension corresponding to the required contact pressure and skirting the contact surfaces, it is attached to the appropriate section of the switch housing.

Consequently, one single element advantageously meets the mechanical requirements (contact pressure, insulation) while also sealing the unit.

Switches of this type are especially practical for use in small electronic devices, a particular example being hearing aids.

The following description of an implementation example explains this invention in more detail with the aid of the drawings in which—

Figure 1:
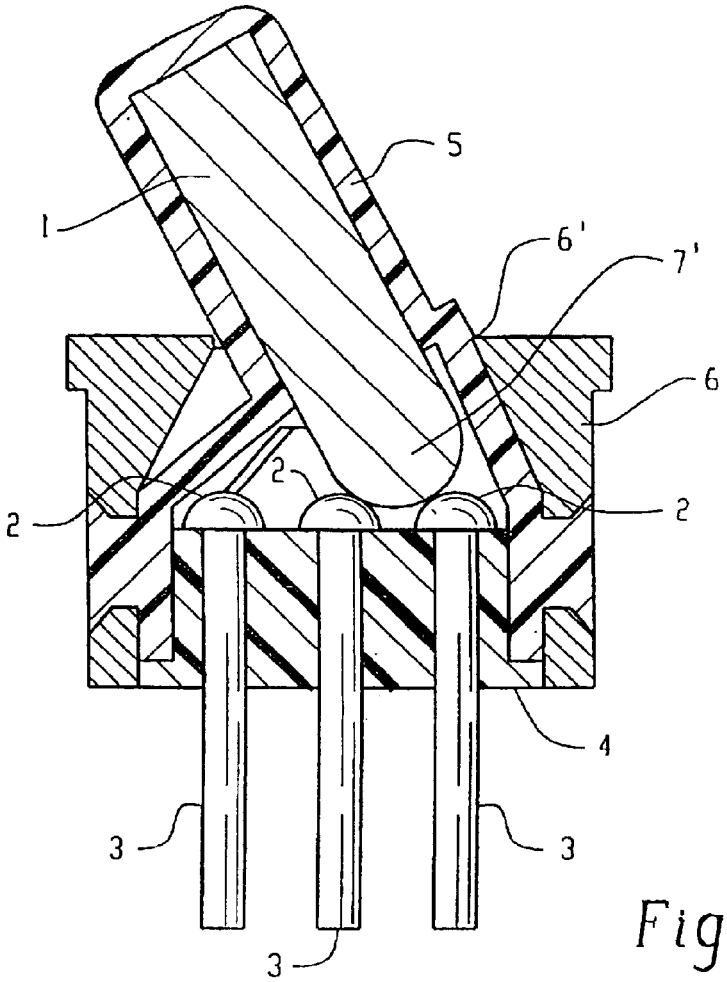
FIG. 1 shows a longitudinal section through a switch according to this invention.

FIG. 1 shows a longitudinal section through a switch designed in accordance with this invention, in which the pin-shaped switching element 1 makes contact with two contact surfaces 2 of three mutually parallel contact pins 3.

In this case, the contact pins 3 are mounted, side-by-side, in the bottom housing section 4 and protrude to the outside for the purpose of establishing an electrical connection with an external circuit (not shown).

The contacting end 1' of the switching element 1 is hemispherical, allowing it to click-lock firmly in the position shown between the two right-hand contact surfaces 2. The elastic force of the diaphragm 5 pushes the switching element 1 against the contact surfaces 2, resiliently holding it in that position.

Since the diaphragm 5 consists of an electrically nonconducting, preferably thermoplastic material, the outside of the diaphragm 5 in the area of the free end of the switching element 1 can itself serve as the actuating surface, obviating the need for a separate actuating component in addition to the switching element 1.

Figure 4:
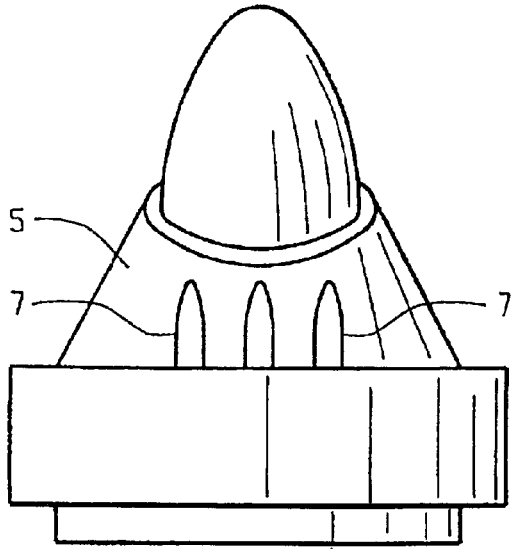
FIG. 4 depicts the diaphragm of the switch per FIG. 1.

The elastic force can be conveniently adjusted by means of notches 7 provided either on the outside or on the inside of the diaphragm 5, as shown in the illustration of the diaphragm in FIG. 4. Depending on their size and number, these notches reduce the elastic retractility of the diaphragm 5, thus allowing for a certain selectability of the actuating force of the switch. The notches may extend longitudinally or horizontally, depending on the desired elastic effect.

The lateral movement of the switching element 1 is limited by the rim of the recess 6' in the upper housing section 6. Accordingly, the switching element 1 can only be shifted from the switch position shown in FIG. 1 to the opposite switch position and back. This establishes a reliable electrically conductive connection between the central contact pin 3 and the corresponding left- or right-hand outer contact pin 3.

The diaphragm 5 thus provides a hermetic seal protecting the switching connections between the switching element 1 and the contact surfaces 2 from the environment around the switch and thus against contaminants and moisture.

The diaphragm 5 extends around the contact surfaces 2, thus also serving as a seal between the bottom section 4 of the housing and the top section 6 of the housing.

As an advantageous feature, the diaphragm 5 is firmly attached to the outer section 6 of the housing as shown in the illustration. This can be done for instance directly as part of the production process or by subsequent installation in that position.

Figure 2:
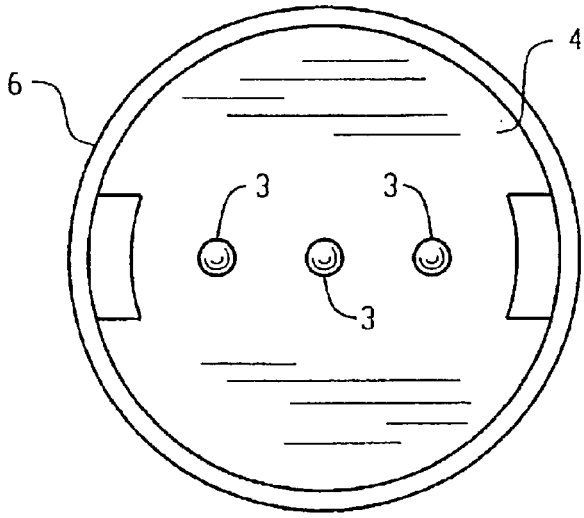
FIG. 2 is a bottom view of the switch per FIG. 1.

The lower section 4 of the housing, visible in the bottom view per FIG. 2 and holding pre-installed contact pins 3, can be inserted from the bottom and attached to the upper housing section 6 which is already equipped with the diaphragm 5 and the switching element 1. The housing sections can be joined in conventional fashion either permanently by cementing or welding them together or simply by snapping them together via suitably shaped junction tabs or strap joints. In either case, the electrical contact area within the switch will be properly and reliably sealed.

Figure 3:
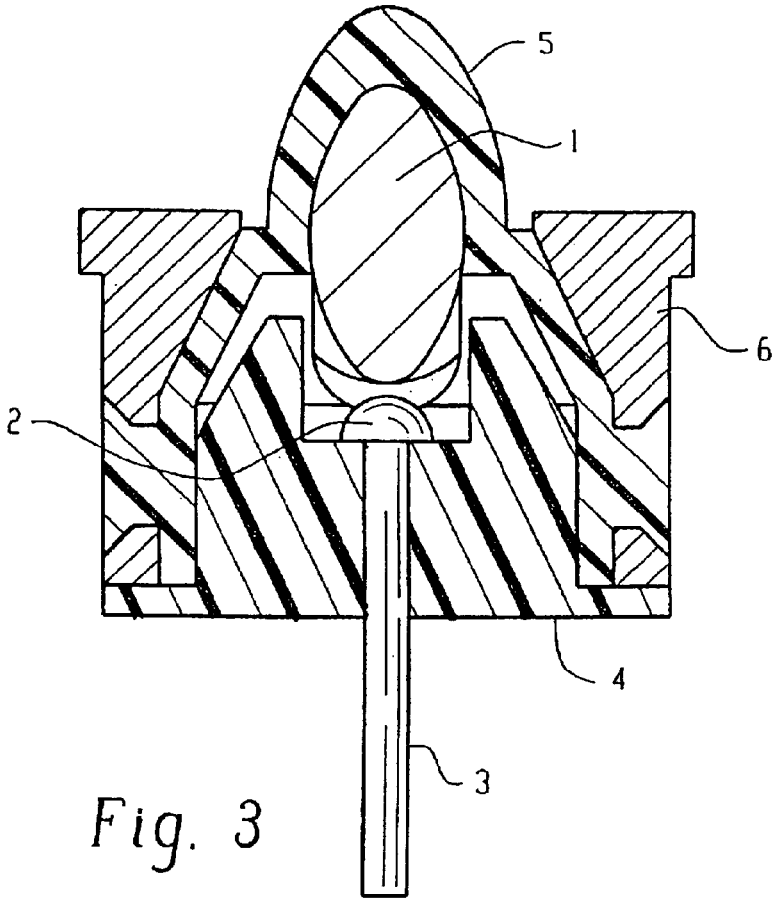
FIG. 3 shows a longitudinal section through the switch as in FIG. 1, offset by 90°.

FIG. 3 again shows a longitudinal section through the switch per FIG. 1, in this case rotated 90°. Here it can be seen, for instance, that the three contact pins 3 are lined up one behind the other in the bottom section 4 of the housing. It can also be seen that the switching element 1 is preferably pin-shaped and preferably in the form of a metal pin with a circular cross section, with its outer surface constituted of the diaphragm 5. This makes for a simple switching element of the switch assembly that is pleasant to the touch and easy to operate.

Figure 5:
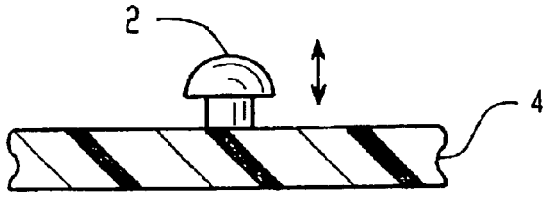
FIG. 5 and FIG. 6 illustrate different configurations of the contact surfaces.
Figure 6:
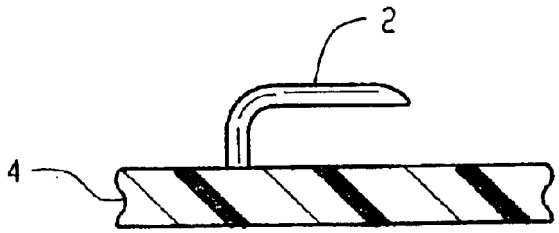

In all of the illustrations the contact surfaces 2 are hemispherical. However, they may also be designed differently, for instance mushroom- or hook-shaped. Conceivably, mushroom-shaped contact surfaces 2 could be used which on their part are resiliently spring-mounted relative to, and in, the bottom section 4 of the housing, as illustrated in the drawings of FIGS. 5 and 6.

Figure 7:
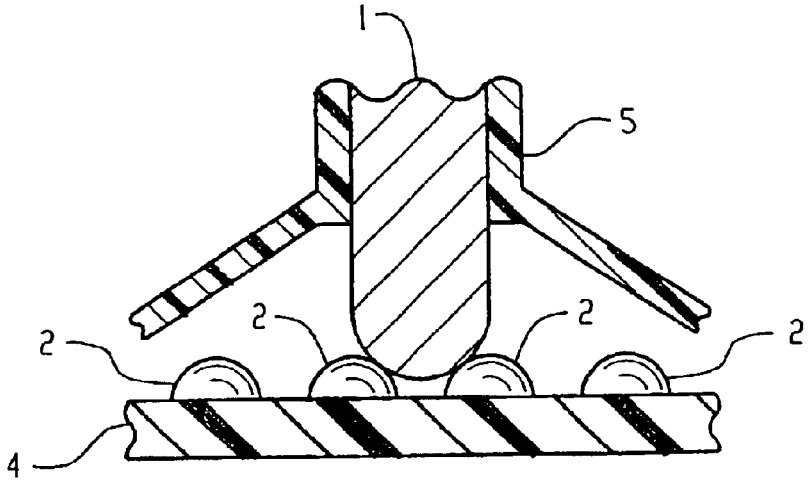
FIG. 7 shows a longitudinal section through the switch mechanism of another design variation of the switch per FIG. 1 with 4 contact surfaces.

Instead of using three contact pins 3, it is equally possible to install four contact pins 3 and contact surfaces 2, allowing not only for two but for three different switch positions of the switching element 1, as indicated in the diagram of FIG. 7. In FIG. 7 the switch is in the center position, electrically connecting the two central contact surfaces 2 by way of the switching element 1. Pushing the switching element 1 from this position to the left or right will connect the two corresponding outer contact surfaces 2.

A substantial advantage of the design illustrated, apart from its sealing properties, lies in the fact that even in comparison with conventional switches it contains fewer parts, since the diaphragm serves at once as a handle or actuator, a seal, and a spring that applies the contacting force. The design presented also allows for considerable miniaturization, whereby this switch is particularly well suited to the integration in small, i.e. miniaturized, electronic devices and especially in hearing aids, devices with particularly heavy exposure to a moist, contaminant-containing environment.

What is claimed is:

1. An electromechanical switch incorporating in a switch housing at least one electrically conductive switching element (1) with associated electrically conductive contact surfaces (2), wherein an area of the switching element (1) that faces away from the contact surfaces is at least partly enclosed by an elastic diaphragm (5) which also encloses at least a region containing the contact surfaces (2) associated with the switching element (1) and tightly butts against the switch housing (4; 6) wherein said diaphragm (5) is prestressed in a transition area between the switching element (1) and the housing (4; 6), thus resiliently pressing the switching element (1) against the contact surfaces (2), wherein the switch housing (4; 6) consists of two sections, with a base plate (4) containing the contact surfaces (2) and a cover (6) with an opening (6') through which protrudes a part of the switching element (1) with a diaphragm (5), wherein said two housing sections (4; 6) are connected in self-locking fashion by clamping or welding.

2. An electromechanical switch incorporating in a switch housing at least one electrically conductive switching element (1) with associated electrically conductive contact surfaces (2), wherein an area of the switching element (1) that faces away from the contact surfaces is at least partly enclosed by an elastic diaphragm (5) which also encloses at least a region containing the contact surfaces (2) associated with the switching element (1) and tightly butts against the switch housing (4; 6) wherein said diaphragm (5) is prestressed in a transition area between the switching element (1) and the housing (4; 6), thus resiliently pressing the switching element (1) against the contact surfaces (2), wherein the switching element (1) is pin-shaped and has a round or oval cross section while its end (1'), which makes contact with the contact surfaces (2) is rounded into a convex tip.

3. An electromechanical switch incorporating in a switch housing at least one electrically conductive switching element (1) with associated electrically conductive contact surfaces (2), wherein an area of the switching element (1) that faces away from the contact surfaces is at least partly enclosed by an elastic diaphragm (5) which also encloses at least a region containing the contact surfaces (2) associated with the switching element (1) and tightly butts against the switch housing (4; 6) wherein said diaphragm (5) is prestressed in a transition area between the switching element (1) and the housing (4; 6), thus resiliently pressing the switching element (1) against the contact surfaces (2), wherein, in the area where it rests against the switching element (1) and/or in the transition area between the switching element (1) and its connection to the switch housing (4; 6), the diaphragm (5) is provided on its inside and/or outside with one or several notches (7).

4. An electromechanical switch incorporating in a switch housing at least one electrically conductive switching element (1) with associated electrically conductive contact surfaces (2), wherein an area of the switching element (1) that faces away from the contact surfaces is at least partly enclosed by an elastic diaphragm (5) which also encloses at least a region containing the contact surfaces (2) associated with the switching element (1) and tightly butts against the switch housing (4; 6) wherein said diaphragm (5) is prestressed in a transition area between the switching element (1) and the housing (4; 6), thus resiliently pressing the switching element (1) against the contact surfaces (2), wherein the contact surfaces (2) comprise contact pins (3) whose ends (2) facing the switching element (1) are hemispherical or mushroom-shaped.

5. An electromechanical switch incorporating in its switch housing at least one pin shaped, electrically conductive switching element (1) with associated electrically conductive contact surfaces (2), wherein an area of the switching element (1) that faces away from the contact surfaces is at least partly enclosed by an elastic diaphragm (5) which also encloses at least a region containing the contact surfaces (2) associated with the switching element (1) and tightly butts against the switch housing (4; 6) wherein said diaphragm (5) is prestressed in a transition area between the switching element (1) and the housing (4; 6), thus resiliently pressing the switching element (1) against the contact surfaces (2) to establish an electrically conductive connection between the contact surfaces.

6. The switch according to any one of claims 1 and 5, wherein the switching element (1) comprises a metal.

7. The switch according to any one of claims 1 and 5, wherein the switch housing (4; 6) comprises a 2-component injection-molded plastic material.

8. The switch according to any one of claims 1 and 5, wherein the elastic diaphragm (5) comprises an elastomeric material.

9. Use of a switch per one of the claims 1, 2, 3, and 4 in miniaturized devices.

10. The use of the switch according to claim 9, wherein the miniaturized devices are hearing aids.

* * * * *